US005664584A

United States Patent [19]

Draghetti

[11] Patent Number: 5,664,584

[45] Date of Patent: Sep. 9, 1997

[54] DEVICE FOR LATERALLY TRANSFERRING AN ORDERLY SUCCESSION OF SMOKING ITEMS

[75] Inventor: Fiorenzo Draghetti, Medicina, Italy

[73] Assignee: G.D Societa' Per Azioni, Bologna, Italy

[21] Appl. No.: 533,085

[22] Filed: Sep. 25, 1995

[30] Foreign Application Priority Data

Oct. 13, 1994 [IT] Italy ..... BO94A0446

[51] Int. Cl.[6] ..... A24C 5/47

[52] U.S. Cl. ..... 131/94; 131/93; 131/95; 131/96

[58] Field of Search ..... 131/94, 93, 95, 131/96

[56] References Cited

U.S. PATENT DOCUMENTS

| | | | |
|---|---|---|---|
| 3,219,167 | 11/1965 | Boinnard | 198/32 |
| 4,645,063 | 2/1987 | Seragnoli | 198/450 |

FOREIGN PATENT DOCUMENTS

| | | | |
|---|---|---|---|
| 2152773 | 6/1982 | France | 198/32 |
| 1912651 | 2/1963 | Germany | 198/32 |
| 1532115 | 6/1995 | Germany | 198/32 |
| 834791 | 5/1960 | United Kingdom | 198/32 |
| 2079133 | 3/1995 | United Kingdom | 198/32 |

*Primary Examiner*—V. Millin
*Assistant Examiner*—Charles W. Anderson
*Attorney, Agent, or Firm*—Ladas & Parry

[57] ABSTRACT

A device for laterally and axially transferring an orderly succession of smoking items, whereby each item is picked up at a first position by a gripping head on a carousel conveyor, and is fed by the carousel conveyor along a curved path into a respective seat on an intermediate roller shifted laterally by a given distance in relation to the first position, and which feeds the item to a second position substantially coaxial with, and shifted said given distance in relation to, the first position.

16 Claims, 2 Drawing Sheets

DEVICE FOR LATERALLY TRANSFERRING AN ORDERLY SUCCESSION OF SMOKING ITEMS

BACKGROUND OF THE INVENTION

The present invention relates to a device for laterally transferring an orderly succession of smoking items.

More specifically, the present invention relates to a device for transferring cigarettes or filters or cigarette portions.

On cigarette manufacturing systems, it is frequently necessary to move a succession of items, traveling crosswise to their axes, from a first to a second position a given distance from the first. This applies, for example, on a filter assembly machine, when double cigarette portions traveling crosswise to their axes are cut in half into two coaxial portions, one of which must be moved axially in relation to the other by a distance equal to the length of a double filter, which is subsequently inserted between the two cigarette portions to form a double cigarette.

SUMMARY OF THE INVENTION

It is an object of the present invention to provide a highly straightforward, low-cost transfer device for laterally transferring smoking items a given distance, and with no limitation in terms of speed.

According to the present invention, there is provided a device for laterally transferring an orderly succession of smoking items; the device comprising conveying means for successively feeding the items along a first and second path offset transversely in relation to each other by a given distance; first and second seating means formed on the conveying means and for receiving respective said items, said first and second seating means being equally spaced respectively along the first and second path; and transfer means for transferring each item from a first position on the first path to a second position on the second path; characterized in that the transfer means comprise a carousel conveyor rotating about its axis; a number of gripping heads movable with and in relation to the carousel conveyor, so as to travel along an annular path tangent to the conveying means at said first position; and an intermediate roller tangent both to the conveying means at said second position and to the annular path.

According to a preferred embodiment of the above device, said conveying means comprise at least one conveyor roller rotating at a given surface speed about a first axis; the intermediate roller rotating about a second axis parallel to the first axis and at a surface speed equal to and in the opposite direction to said given speed, and presenting third seating means equally spaced with the same spacing as said first and second seating means; and said carousel conveyor rotating about its axis to move said gripping heads along the annular path at a speed equal to said given speed, and through the first position and into a position of tangency with the intermediate roller in time with said first and third seating means respectively.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
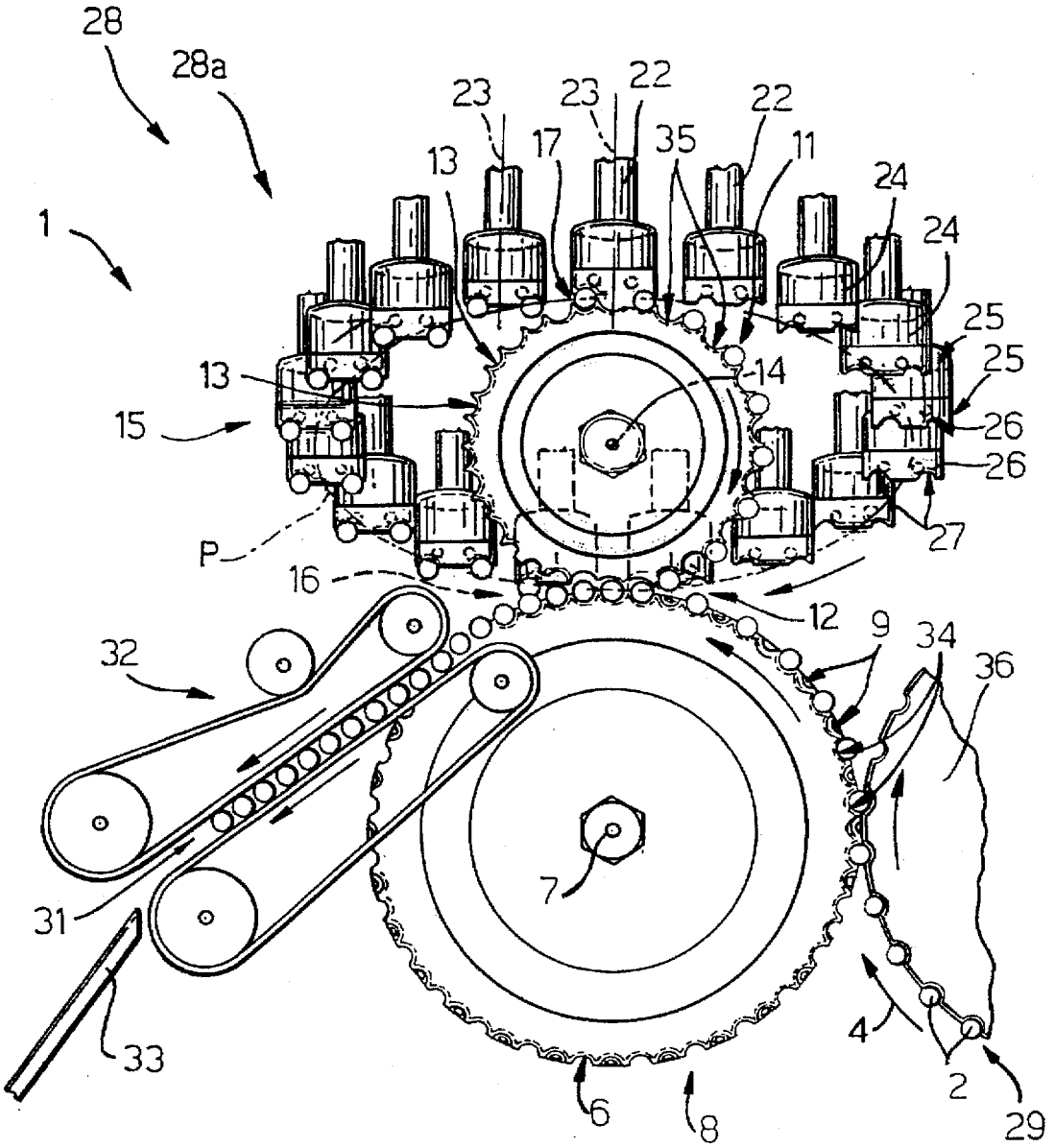
FIG. 1 shows a side view, with parts removed for clarity, of a preferred embodiment of the device according to the present invention.
Figure 2:
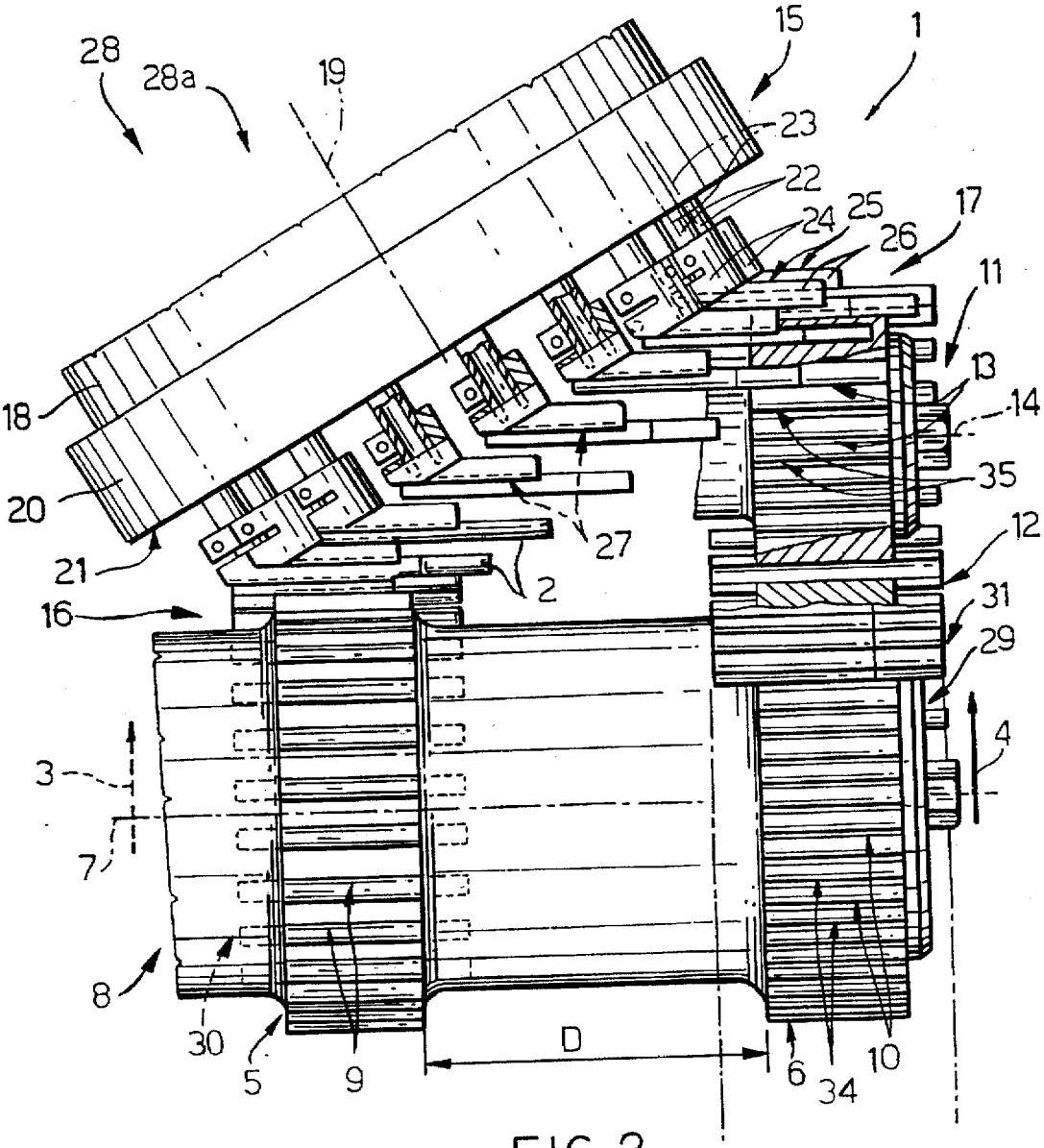
FIG. 2 shows a larger-scale front view of the FIG. 1 device, with parts in section and parts removed for clarity.

Number 1 in FIGS. 1 and 2 indicates a transfer device for successively engaging cigarettes 2 traveling crosswise to their axes along a path 3, and transferring cigarettes 2 so that they travel along a path 4 offset laterally in relation to path 3 in a direction parallel to the axes of cigarettes 2.

As shown more clearly in FIG. 2, device 1 comprises an input roller 5 and an output roller 6 separated by a distance D along the same axis 7, and forming part of a single drum 8 rotated anticlockwise (in FIG. 1) about axis 7 and at substantially constant angular speed by a known drive device (not shown). Roller 5 presents a number of longitudinal peripheral suction seats 9, each for retaining a respective cigarette 2, and each preferably coaxial with a corresponding longitudinal suction seat 10 on the periphery of roller 6.

According to a variation not shown, drum 8 is replaced by a single elongated roller similar to rollers 5 and 6, and presenting longitudinal peripheral suction seats, each comprising a first portion corresponding to a seat 9, and a second portion corresponding to a seat 10.

As shown in FIG. 2, device 1 also comprises an intermediate roller 11 tangent to roller 6 at a transfer station 12, and presenting a number of longitudinal peripheral suction seats 13 equally spaced with the same spacing as seats 9 and 10. By means of a known drive device (not shown), roller 11 is rotated clockwise (in FIG. 1) about its axis 14, parallel to axis 7, at the same surface speed as, and in time with, roller 6, so that each seat 13 travels through station 12 simultaneously with a seat 10.

As shown in FIG. 2, device 1 also comprises a transfer unit 15 for successively receiving cigarettes 2 fed by roller 5 through a loading station 16 located along the periphery of roller 5 in the plane defined by axes 7 and 14—hereinafter referred to as plane 7-14—and for transferring them to an unloading station 17 located in plane 7-14 along the periphery of roller 11 and diametrically opposite transfer station 12.

Unit 15 comprises a support 18 with an axis 19 located in plane 7-14; and a carousel conveyor 20 fitted to support 18 and rotated anticlockwise (in FIG. 2) at constant angular speed about axis 19 by a known drive device (not shown), and presenting a flat, circular end surface 21 facing drum 8. Conveyor 20 supports a number of shafts 22, the axes 23 of which extend perpendicularly from surface 21 towards drum 8, and are equally spaced about the circumference of surface 21 and coaxially with axis 19. As shown in FIG. 2, by means of a substantially cylindrical fastening sleeve 24, each shaft 22 is fitted on its free end with a gripping head 25, which comprises a plate 26 extending parallel to axes 7 and 14 and perpendicularly to plane 7-14, and presenting, on the side facing drum 8, two side by side suction seats 27 separated by a distance equal to that between two adjacent seats 9 or 13.

Figure 3:
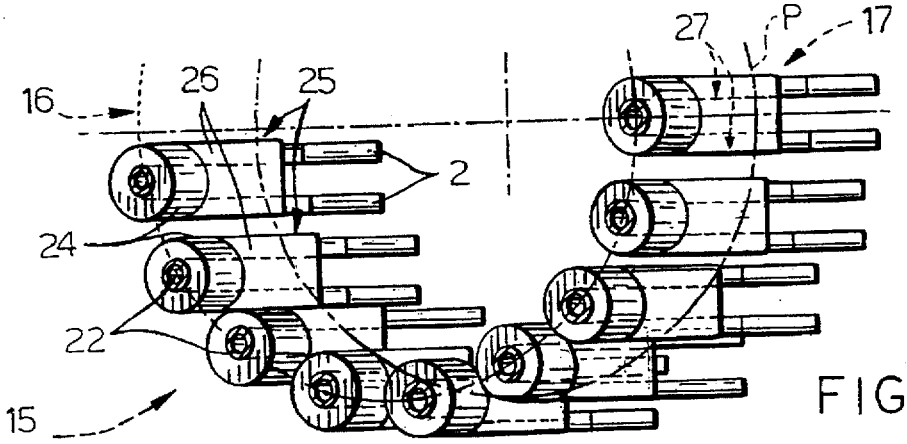
FIG. 3 shows a partial, larger-scale plan view of a detail in FIG. 1.

As shown particularly in FIG. 3, shafts 22 are fitted to conveyor 20 so as to rotate in relation to conveyor 20 and about respective axes 23 in the opposite direction to conveyor 20 and at the same angular speed at which conveyor 20 rotates about axis 19. Such a movement is achieved in known manner by interposing, between conveyor 20 and shafts 22, a known epicyclic transmission (not shown), each planet gear (not shown) of which is fitted to a respective shaft 22, and which, as conveyor 20 rotates about axis 19, provides for moving plates 26 parallel to themselves and with respective seats 27 parallel at all times to seats 9 and 13.

As shown in FIG. 2, axis 19 is inclined in relation to axes 7 and 14; axes 23 are parallel to axis 19; and each plate 26 forms, with respective axis 23, an angle equal to that formed by axis 19 with axes 7 and 14, and of such a size as to permit each plate 26 to move, as it rotates about axis 19, along an annular path P through loading and unloading stations 16 and 17, and so that it is tangent to roller 5 at station 16, and to roller 11 at station 17. Conveyor 20 is also so timed in relation to drum 8 and roller 11 that two seats 27 of a first head 25 travel through station 16 at a constant speed equal to that of seats 9 and simultaneously with two seats 9; and two seats 27 of a second head 25, diametrically opposite the first, travel through station 17 simultaneously with two seats 13 traveling, as stated, at the same speed as seats 9 and 10.

In actual use, cigarettes 2 fed along path 3 into seats 9 on roller 5 are fed by roller 5 to loading station 16 where they are removed two by two by heads 25 and transferred by unit 15 to station 17. The cigarettes 2 in each pair are transferred by respective head 25 from station 16 to station 17 with no change in their orientation; are released by head 25 inside two successive seats 13 on roller 11; and are fed successively by roller 11 to station 12 where they are transferred into respective seats 10 shifted axially in relation to seats 9 by a distance D which may be varied as required by varying the diameter of conveyor 20.

In other words, device 1 provides, in a straightforward, low-cost manner and in relatively little space, for moving cigarettes 2 axially by a distance D with no change in their orientation.

Device 1 may be used for axially displacing not only cigarettes but also other elongated smoking items, such as filters or cigarette portions, from a first to a second given axial position as they travel in a direction crosswise to their axes.

In the FIG. 1 example, device 1 forms part of an output device 28*a* used in conjunction with a filter assembly machine 28 of the type described in European Patent Application n. 586 919, i.e. of the type presenting two parallel outputs, defined by rollers 5 and 6, for two successions 29 and 30 of equioriented cigarettes 2, for converting successions 29 and 30 into one succession 31 which is supplied by roller 6 to a known single-cigarette conveyor device 32 connected in known manner by a chute 33 to the input of a bulk cigarette conveyor (not shown).

For device 1 to be used as described above, in addition to seats 10, roller 6 also presents seats 34 equally spaced about the periphery of roller 6 with the same spacing as, and alternating with, seats 10; and roller 11 presents dummy seats 35 alternating with seats 13 and each traveling through station 12 simultaneously with a respective seat 34.

In actual use, as cigarettes 2 in succession 30 are fed successively into seats 9 by a roller (not shown) tangent to the outer surface of roller 5 upstream from station 16 in the rotation direction of roller 5, cigarettes 2 in succession 29, which are equioriented in relation to those in succession 30, are fed successively into seats 34 by a roller 36 tangent to the periphery of roller 6 upstream from station 12 in the rotation direction of roller 6; and the cigarettes 2 in succession 30 fed on to roller 5 are shifted axially by device 1 on to roller 6 and so that they alternate with cigarettes 2 in succession 29 to form succession 31, which is fed from roller 6 to conveyor device 32.

I claim:

1. A transfer device for transversely transferring an orderly succession of elongated smoking items (2); the device (1) comprising conveying means (5, 6) for successively transversely feeding the items (2) along a first path and a second path (3, 4), said first path and said second path being parallel to each other and offset transversely in relation to each other by a given distance (D); first and second seating means (9, 10) formed on the conveying means (5, 6) for receiving respective said items (2), said first and second seating means (9, 10) being equally spaced respectively along, and being arranged respectively transversely to, the first and second paths (3, 4); and transfer means (15) for transferring each item (2) from a first position (16) on the first path (3) to a second position (12) on the second path (4); said transfer means (15) comprising a carousel conveyor (20) rotating about its axis (19); a number of gripping heads (25) movable with and in relation to the carousel conveyor (20), so as to travel along an annular path (P) tangent to the conveying means (5, 6) at said first position (16); and an intermediate roller (11) tangent both to the conveying means (5, 6) at second position (12) and to the annular path (P).

2. A device as claimed in claim 1, wherein said conveying means comprises at least one conveyor roller (5, 6) rotating at a given surface speed about a first axis (7); the intermediate roller (11) rotating about a second axis (14) parallel to the first axis (7) and at a surface speed equal to and in the opposite direction to said given speed, said intermediate roller having third seating means (13) equally spaced with the same spacing as said first and second seating means (9, 10); said carousel conveyor (20) rotating about its axis (19) to move said gripping heads (25) along the annular path (P) at a speed equal to said given speed, and through the first position (16) and into a third position (17) of tangency with the intermediate roller (11) in time with said first and third seating means (9, 13) respectively.

3. A device as claimed in claim 2, wherein the axis (19) of the carousel conveyor (20) is coplanar with and inclined in relation to said first and second axes (7, 14).

4. A device as claimed in claim 3, wherein each said gripping head (25) includes fourth seating means (27) cooperating with respective first and third seating means (9, 13) at the first position (16) and said position of tangency (17) respectively.

5. A device as claimed in claim 4, wherein said seating means (9, 10, 13, 27) all extend parallel to the first axis (7).

6. A device as claimed in claim 2, which forms part of the output device of a filter assembly machine with two outputs for respective successions of equioriented cigarettes.

7. A device as claimed in claim 6, wherein the conveying means (5, 6) comprises a first (5) conveyor roller and a second (6) conveyor roller, said first and second conveyor rollers rotating about the first axis (7) at said given surface speed and respectively presenting said first (9) and second (10) seating means; said first and second rollers (5, 6) being located respectively along the first (3) and second (4) paths; the intermediate roller (11) being tangent to the second roller (6), and having a number of dummy seats (35) alternating with said third seating means (13); the second roller (6) having fourth seating means (34) alternating with said second means (10); and said first (9) and fourth (34) seating means receiving respective successions (29, 30) of equioriented items (2).

8. A device as claimed in claim 1, wherein said items are transferred in said seating means along said first and second paths in parallel relation, cross wise to said paths.

9. A device according to claim 1, wherein said intermediate roller is disposed between said carousel conveyor and said conveying means which conveys the items along said second path.

10. A device according to claim 1, wherein said conveying means comprises input and output rollers, parallel to one another in transversely spaced relative and rotatable about a common axis for respective feeding said items along said first and second paths.

11. A device according to claim 10, wherein said intermediate roller is parallel to said input and output rollers.

12. A device according to claim 11, wherein said intermediate roller and said input and output rollers rotate in opposite directions.

13. A device according to claim 11, wherein said intermediate roller is parallel to said input roller.

14. A device according to claim 10, wherein said axis of rotation of said carousel roller lies in a common plane containing said common axis of rotation of said input and output rollers and said axis of rotation of said intermediate roller.

15. A device according to claim 14, wherein said axis of rotation of said carousel conveyor in said common plane is inclined at an angle relative to the common axis of rotation of said input and output rollers.

16. A device according to claim 10, wherein said intermediate roller has an axis of rotation parallel to said common axis of rotation of the input and output rollers, and defines a common plane therewith, said axis of rotation of said carousel conveyor being disposed in said common plane and forming an angle with said common axis.

* * * * *